United States Patent [19]

De Schamphelaere et al.

[11] Patent Number: 4,611,905

[45] Date of Patent: Sep. 16, 1986

[54] TONER DISPENSING CONTROL

[75] Inventors: Lucien A. De Schamphelaere, Edegem; Freddy M. Librecht, Boechout; Willy G. Verlinden, Edegem, all of Belgium

[73] Assignee: AGFA-GEVAERT N.V., Mortsel, Belgium

[21] Appl. No.: 664,421

[22] Filed: Oct. 24, 1984

[30] Foreign Application Priority Data

Nov. 1, 1983 [EP] European Pat. Off. ..... 83201564

[51] Int. Cl.[4] ..... G03G 15/08; G03G 21/00

[52] U.S. Cl. ..... 355/14 D; 118/689; 355/3 DD

[58] Field of Search ..... 355/3 R, 3 DD, 14 D; 118/688, 689, 690; 222/DIG. 1

[56] References Cited

U.S. PATENT DOCUMENTS

| | | | |
|---|---|---|---|
| 3,409,901 | 11/1968 | Dost et al. | 355/14 D X |
| 3,529,546 | 9/1970 | Kollar | 355/14 D X |
| 4,032,227 | 6/1977 | Hubbard et al. | 355/14 D |
| 4,108,545 | 8/1978 | Eckert et al. | 355/14 D |
| 4,190,018 | 2/1980 | Ariotti et al. | 118/690 |
| 4,210,864 | 7/1980 | Miyakawa et al. | 355/3 DD X |
| 4,260,073 | 4/1981 | Baumonn | 355/3 DD X |
| 4,342,283 | 8/1982 | Terashima | 355/3 DD X |
| 4,343,548 | 8/1982 | Bares et al. | 355/14 D X |
| 4,413,264 | 11/1983 | Cruz-Uribe et al. | 355/14 D X |
| 4,468,112 | 8/1984 | Suzuki et al. | 355/14 D |

FOREIGN PATENT DOCUMENTS 57-146263 9/1982 Japan .

*Primary Examiner*—Fred L. Braun

*Attorney, Agent, or Firm*—William J. Daniel

[57] ABSTRACT

Toner dispensing control in a xerographic printer wherein a toner dispenser is controlled in response to a reference magnetic density value that is variable during the running-in period of a fresh toner mixture, thereby to take account of the changing packing density of the mixture during such period.

5 Claims, 4 Drawing Figures

TONER DISPENSING CONTROL

The present invention relates to a method and a device for toner dispensing control in a xerographic printer of the type wherein a photoconductor is electrostatically charged and image-wise exposed by line-wise exposing the photoconductor by appropriate activation of a plurality of linearly-spaced discrete sources of radiation in response to corresponding data bits.

In xerographic printers wherein a photoconductor is electrostatically charged, image-wise exposed, and finally developed by contact with a toner mixture attracted thereto from a mixture of magnetically susceptible carrier particles and toner powder provided in a developing station, there is provided a toner dispenser for adding toner powder to the mixture as the toner powder is being consumed on development of the electrostatic charge pattern in order to keep the concentration of the mixture constant.

It is known to control the concentration of the toner mixture by inductively measuring the carrier concentration i.e. the amount of carrier per unit of volume, comparing the measured concentration with a set value, and using the deviation between both values as a signal to control the toner dispenser to add toner powder. This control is based on the ferro-magnetic character of the carrier particles, and on variations in the coefficient of self-induction of a coil as a consequence of variations in the concentration of carrier particles within the electromagnetic field of the coil. This method of control is known for instance from EU application No. 83 200 134.1, relating to an apparatus employing a bridge incorporating induction coils for monitoring the concentration of toner in a toner/carrier mixture, and copying apparatus incorporating same.

This method of control does not operate satisfactorily in practice, since it has been shown that there occurs a significant deviation in the correct response of the control during the running-in period of a new toner mixture, which period may cover the production of some thousands of prints.

During this running-in period the carrier concentration increases as a consequence of different factors, the most important of which are as follows:

(a) The geometry of the carrier particles changes from a rather irregular form towards a more spherical shape as a consequence of wear suffered by the carrier particles during the running-in of a new toner mixture.

(b) The toner particles of toner additives that are present in the toner mixture tend to deposit as a smear on the carrier particles particles whereby the mobility of the carrier particles is increased, and (c) toner particles adhering to the carrier particles under the influence of Van der Waals' forces increase the relative mobility of the carrier particles.

The varying influence of these factors disappears after a eriod of use, called the running-in period, which correspons with the production of some thousands of prints.

The consequence of the increased packing density of the carrier particles of the toner mixture during this running-in period is that the inductive concentration measurement will show an increased carrier concentration during this period and one would, therefore, derive therefrom the erroneous conclusion that this has been caused by an exhaustion of toner powder, so that the toner dispenser should be controlled to add toner powder to the toner mixture, with the result that overtoneering occurs. This causes an increase of the fog level on the print, a too high density of the image, and the risk of thick and smeary lines.

It is possible to overcome this difficulty by the artificial ageing of a new toner mixture by the manufacturer of the toner mixture. Such procedure cannot perfectly simulate the ageing of the toner mixture in normal use, and is economically not attractive since it increases the cost-price of the product and at the same time reduces its life, i.e. the number of copies that can be produced with given amount of carrier particles.

It is also possible to provide the control device with supplementary control means, for instance operated in response to a density measurement of the produced print image (occasionally a test zone or a test pattern on such print image or on the toner image while still on the photoconductor), and using a feedback loop from such density measurement to control toner dispensing. However such an arrangement control means is expensive and is not completely reliable.

It is the object of the present invention to provide an improved method and device for toner dispensing control in a xerographic printer, in particular in a high-resolution intelligent printer of the type wherein the image-wise exposure of the photoconductor occurs by line-wise exposture of the photoconductor by appropriate activation of a plurality of linearly-spaced discrete sources of radiation.

In accordance with the present invention, a method is provided for controlling the dispensing of toner powder in xerographic printing of the type wherein a photoconductor is electrostatically charged and image-wise exposed by line-wise exposing the photo-conductor by appropriate activation of a plurality of linearly-spaced discrete sources of radiation in response to corresponding data bits, and the electrostatic image thus produced is developed by contact with a toner mixture comprising magnetically susceptible carrier particles and toner powder which is attracted thereto at a developing station provided with a toner dispenser for dispensing toner to the toner-depleted mixture, and wherein operation of said toner dispenser is controlled in response to a control signal produced when the magnetic density of the toner mixture deviates from a reference density by a predetermined amount, characterized in that the reference density is changeable during the lifetime of the toner mixture, the said set density having an initial value at the start of the running-in period of a new toner mixture which is effective to provide satisfactory toner dispensing control at that moment, the set density having a final value at the end of the running-in period which provides satisfactory toner control during the remainder of the lifetime of the toner mixture, and the set density having during the running-in period at least one other value intermediate the initial and final values which provides at a corresponding intermediate time a satisfactory toner control, these at least three set density values having been obtained by pre-assessing the change in characteristics of a new toner mixture during the running-in period thereof.

The expression "linearly-spaced discrete sources of radiation" denotes in the present specification one or more linear arrays of LED's (light emitting diodes) or like stationary radiators, that may be individually or group-wise energized to produce the desired exposure of the photoconductor. The expression includes also a scanner, e.g. a laser scanner, the beam of which is modulated during the scanning to determine during each scan movement a plurality of elementary image sites that may receive radiation or not depending on the modulation of the radiation beam.

The sources of radiation may be sequentially operative, as in a laser scanner, but they may also be groupwise operative, as in a linear array of LED's where the recording signal is fed to the LED's through a serial-in/parallel-out register, and a latch register, so that all the LED's that are required for the writing of one image line, may be energized all together during the same period of time.

The developed toner image of the photoconductor may be transferred to another support, e.g. a plain paper sheet, to which it may be fixed to constitute the final image, but the invention does not exclude a photoconductor where the toner image is fused on the photoconductor itself thereby to form the final image. Further, a support with a fixed toner image may also be used after suitable treatment to constitute a planographic printing plate.

The method according to the invention enables a toner concentration of the toner mixture, i.e. an amount of toner powder per amount of carrier particles, to be obtained that shows less deviations from a desired value than are obtained with prior art processes wherein only one reference magnetic density value is used.

In a preferred form of the method according to the invention, there are provided a plurality of other set density values that each represent a correct reference density value at a particular stage of running-in period of a new toner mixture, and the application of each such particular value is governed by the elapsed operating time of the toner mixture. In this way, it may be ensured that toner concentration variations from actual remain within close limits throughout life of the toner mixture, and this in spite of substantial variations of the carrier concentration.

The number of exposure cycles may be used as a measure of the elapsed operating time of the toner mixture.

The invention includes also a device for performing the control of toner dispensing in a xerographic printer.

According to this aspect of the invention, a toner dispensing control device is provided in a xerographic printer of the type wherein a photoconductor is electrostatically charged and image-wise exposed by line-wise exposing the photoconductor by means of appropriate activation of a plurality of linearly-spaced discrete sources of radiation in response to corresponding data bits, and developed by contact with a toner mixture attracted thereto from a mixture of magnetically-susceptible carrier particles and toner powder in a developing station provided with a toner dispenser, such control device comprising a magnetic density measuring circuit with means for measuring the magnetic density of carrier particles, means for producing a reference density, and means for comparing the measured density with the reference density and producing upon deviation of the measured from the referenced magnetic density a toner dispensing signal, characterized that the means for producing the set density is capable of producing a variable set density, such means being controlled by control means that produces an output signal as a function of the time of use of the toner mixture, this control means being responsive to time measuring means that measures the time of operation of the toner mixture.

The time measuring means is suitably formed by a print counter that signals the number of prints being made.

The invention wll be described hereinafter by way of example with reference to the accompanying drawings wherein.

Figure 1:
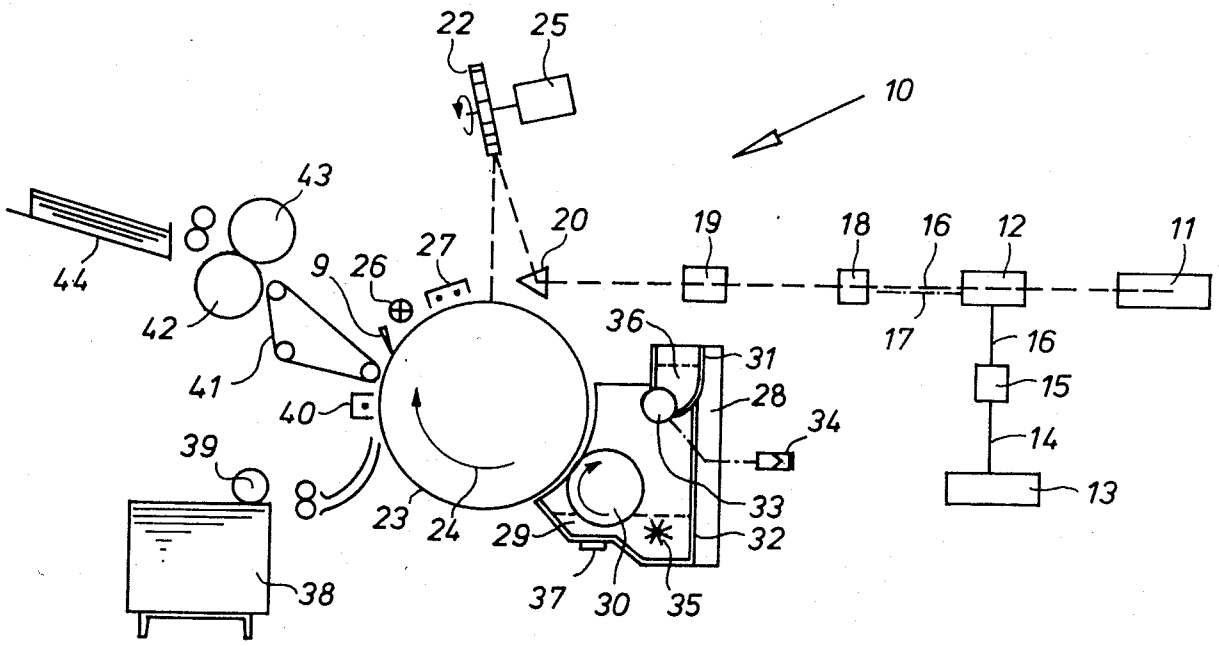
FIG. 1 is a diagrammatic illustration of one embodiment of a laser printer.

FIG. 1 generally designates a laser printer 10. A laser light source 11 transmits a collimated light beam to light beam modulator 12. Signals which designate data bits (ones or zeros in the binary system), from character generator 13 and which represent portions of alphanumeric characters to be printed by the laser printer 10 are sequentially transmitted over line 14 to RF (radio frequency) generator 15. If one bit signal is transmitted, RF generator 15 transmits a RF voltage over line 16 to light modulator 12, otherwise no RF voltage is transmitted. The individual bit signals are gated or clocked from character generator 13 by a character generator clocking signal.

The light beam modulator 12, which in the embodiment illustrated is an acousto-optical modulator which, in response to RF voltages establishes acoustic vibrations which cause a portion of the input radiation beam to be diffracted through a specific angle along a deflected path. The portion of the deflected beam is termed the first order beam 16 while the undeflected beam is termed the zero-order beam 17.

The modulated beam is then passed through a negative lens 18 and an adjustable positive lens 19 which together co-operate to control the size and focus of the first order beam. From there, the modulated beam impinges on prism 20, and then upon a multifaceted rotating reflection mirror 22 driven by a motor 25.

Rotating mirror 22 acts on the modulated beam reflecting it toward the photoconducting drum 23 while at the same time causing it to sweep repeatedly within fan-like fashion in a plane. In a preferred embodiment, only the first order beam 16 is enabled to impinge upon the surface of the photoconducting drum 23. Hence, when logic signals stored in the character generator memory are transmitted as "high" bit signals to RF generator 15 which causes RF pulses to be transmitted to light beam modulator 12 which in turn causes first order beam 16 to be switched on, then light impinges on photoconducting drum 23 to image a dot thereon.

Photoconducting drum 23 is caused to rotate in the direction of the arrow 24 while the periodically sweeping laser beam traverses a series of parallel straight lines across the surface of the drum. The straight lines are parallel to the axis of the drum.

Rotating mirror 22 is a highly polished multi-faceted mirror rotating several hundreds of revolutions per minute, so that adjacent straight lines traversed on the photoconducting drum 23 may be designed to be approximately 0.0625 mm apart. Since the first order light beam is caused to switch on and off at a RF frequency in the order of magnitude of tens of Megacycles, each straight line path is comprised of many possible dot spaces, for instance 3456 in a 21 cm straight line segment.

When a first order beam strikes the drum the electrostatically charged drum is locally discharged at the exposure site, so that development of the charge image by a toner charged to the same polarity as the initial charging of the drum, may cause a dark dot to be recorded on the final output of the printer.

When the beam is not present, a white space is left on the print. In this way, alphanumeric characters are printed as a series of dots and spaces in accordance with data bits produced in the character generator.

The processing of the photoconducting drum is as follows. Prior to the dot-wise exposure, drum 23 is scraped by a scraper 9 in order to remove any residual toner, and uniformly flooded with light from a source 26 in order to completely discharge the photoconductor after the previous exposure. The photoconducting drum 23 is then uniformly electrostatically charged by corona discharge from a charging station 27.

The dot-wise discharged charge pattern remaining after exposure by the laser beam, is developed in a developing station 28 containing a two-component developing mixture 29 which is composed of triboelectrically chargeable toner powder and magnetisable carrier particles, and which is fed to the developing site by a so-called magnetic brush 30 which is a roller with magnets provided in its interior space, whereby a layer of developer mixture is pulled upwardly by the roller as the roller rotates in the illustrated direction. A suitable toner transfer potential difference is maintained between the brush 30 and the drum 23. The developing station comprises also a toner dispenser with a toner tank or hopper 31 provided above the developer tank 32 for storing toner powder 36 therein, and has at its lower portion an opening for supplying the toner therethrough, and toner supplying roller 33 with a mantle of open-cell polymer foam that closely fits to the opening. Stepwise rotation of roller 33 under control of a solenoid 34 that actuates a pawl that engages a toothed pawl wheel fitted on the shaft of the roller (not illustrated), causes the roller to remove at each angular step a controlled amount of powder from the hopper 31, which powder falls by gravity in the developer mixture 29 in the tank 32, and is mixed therewith through the stirring wheel 35. Finally there is provided a measuring coil 37 at the bottom of the developer tank for sensing the magnetic concentration of the developer mixture.

The developed toner image on the drum 23 is transferred to a plain paper sheet fed from a stack 38 of such sheets. A dispenser roller 39 removes each time the upper sheet from the stack, and feeds it in timed sequence towards the drum 23 so that the leading sheet edge coincides with the leading edge of the toner image on the drum. A transfer corona 40 causes the transfer of the toner image of the drum towards the paper sheet. The sheet is then transported by a belt conveyer 41 towards a fixing station where the toner image is fused into the sheet under the application of heat and pressure by rollers 42 and 43. The prints are finally received in a tray 44.

Figure 2:
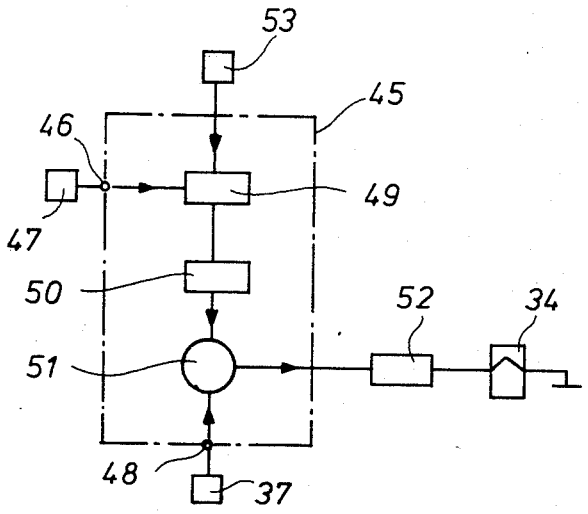
FIG. 2 is a diagrammatic illustration of one embodument of a toner dispensing control circuit for the printer of FIG. 1.

One embodiment of the toner dispensing control of the printer is illustrated diagrammatically in FIG. 2. The control circuit comprises a signal processor 45 which has an input 46 for receiving the signal from a print counter 47, an input 48 for receiving the measuring signal from the transducer 37, signal control means 49 for generating an output signal that is a function of the number of prints made, according to a pre-established program, a reference signal generator 50 that is responsive to the control means 49, a comparator circuit 51 for producing a control signal when the measuring signal deviates from the reference magnetic density signal by a pre-determined value, and a driver 52 for exciting the relay 34 of the toner dispenser in response to an output signal from the comparator 51. Finally there is a resetter 53 which permits the counter input of the signal control means 49 to be reset to zero as new toner mixture has been loaded in the apparatus.

Figure 3:
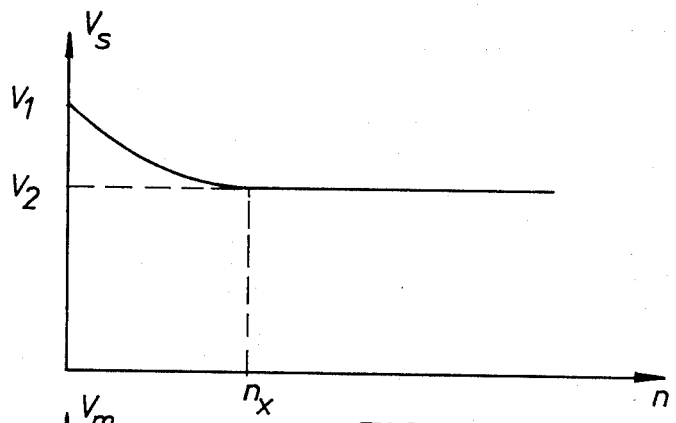
FIG. 3 is a diagram illustrating the reference magnetic density value $V_s$ as a function of the number of produced prints.

The output signal $V_s$ of the signal control means 49 is illustrated in the diagram of FIG. 3, which illustrates the magnitude of $V_s$ as a function of the number n of copies made. The signal has a value $V_1$ at the start of a new toner mixture, and decreases gradually towards $V_2$ as a number $n_x$ corresponding with the end of the running-in of the toner mixture of prints has been made.

Figure 4:
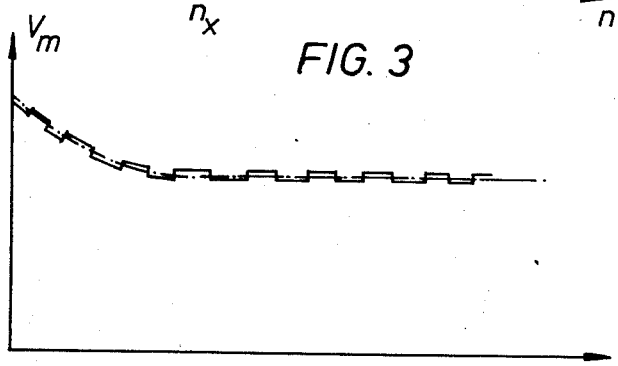
FIG. 4 is a diagram, illustrating the measuring signal $V_m$ of the printer.

The measuring signal $V_m$ of the apparatus is illustrated in the diagram of FIG. 4. The ideal signal is illustrated by the broken line which corresponds with the curve of FIG. 3. The actual signal is illustrated by the stepped drawn line, the steps illustrating the deviations between the true and the desired signal that occur as a consequence of the time delay in the control of the dispensing caused by the dispensing, the transporting and the mixing operations involved.

The pre-assessing of the change in measuring signal as a function of the time of use of a new toner mixture —for a constant toner concentration—proceeds by an experimental procedure in which a fresh toner mixture is subjected to repeated exposures, and the relation between the toner concentration and the measuring signal is measured and put into an equation. The signal control means 49 is then programmed in accordance with the equation to produce the required variations of the reference density signal during the running-in period of the toner mixture.

Thus the reference magetic density value which is effective at any moment is dependent on the number of prints already produced. Depending on the information contents of the produced prints, more or less toner powder will be consumed, and the toner dispenser will add toner to maintain a constant toner concentration. The mechanical agitation of the developer mixture, on the contrary, is only a function of the number of produced prints, because each print involves a given time of operation of the mechanism of the apparatus.

It is clear that the notion "number of prints" could be replaced by the "number of exposures" since an exposure command even executed without copying paper loaded into the apparatus, will cause the same agitation of the toner mixture as that obtained during a normal print cycle. Since the term "print" is often used, among others for indicating on the counter of the apparatus the number of prints that have already been made, this term is preferred for the purposes of the present description.

After the toner mixture has been run-in, there is a fixed relationship between toner concentration and magnetic density of the carrier particles, so that the reference magnetic density does not alter anymore.

In a preferred arrangement of the control circuitry of the apparatus, the function of the signal control means 49 is performed by a microprocessor, and in an even more preferred arrangement, all the functions located within the signal processor 45 are performed by a micro-processor. It will further be clear that such microprocessor is the ideal tool for performing many other control functions in an apparatus of the described kind. Such other functions may include the control of the voltage of the source of high tension that is connected to the corona charging station 27, and the control of the bias voltage of the magnetic brush 30, in order to take account of temperature and fatigue of the photoconductor. Still other functions may include the signalling of a shortage of toner powder, of copying paper, of the useful life of the toner mixture, etc.

The following example illustrates the operation of an apparatus according to the invention.

Type of printer: a laser type printer with a selenium coated drum for producing prints on standard DIN A4 format plain paper.

Composition of toner mixture:

carrier weight: 600 g toner weight: 28.8±1.8 g

Average toner consumption: 0.7 mg/cm2

Reference denisty value $V_1$ at start of a new toner mixture: 4.14 V

Reference density value $V_2$ at the end of the running-in ($n_x$=4000): 3.0 V

Lifetime of the toner mixture: 50.000 prints

It was shown that deviations of a desired toner concentration of 4.8%, remained smaller than ±0.3%.

It is clear that the invention is not limited to the described embodiment of a printer.

A laser printer can comprise a galvanometer controlled mirror to sweep the recording beam, rather than a multifaceted mirror wheel as illustrated.

The printer can comprise a multiplicity of stationary radiation sources, rather than a moving radiation beam. An example of the latter type of printer is formed by so-called LED array printers wherein LED chips are arranged in linear fashion to provide one or two rows of LED's that extend transversely of the path of movement of a photoconductor, and that are focussed, occasionally through self-focussing fibers or the like, onto the photoconductor surface. An example of such printer may be found in our co-pending EU Application No. 82 201 324.9.

The dispensing roller of the toner dispenser may be otherwise rotated than by a pawl mecahnism, e.g. by a step motor, or a servo-motor with reduction gearbox, the time of operation of which may be constant or variable.

The toner dispenser may have another dispensing member than a foamed roller, e.g. an embossed or otherwise profiled hard roller.

We claim:

1. A method for controlling the dispensing of toner powder in xerographic printing of the type wherein a photoconductor is electrostatically charged and image-wise exposed by line-wise exposing the photo-conductor by appropriate activation of a plurality of linearly-spaced discrete sources of radiation in response to corresponding data bits, and the electrostatic image thus produced is developed by contact with a toner mixture comprising magnetically susceptible carrier particles and toner powder which is attracted thereto at a developing station provided with a toner dispenser for dispensing toner to the toner-depleted mixture, and wherein operation of said toner dispenser is controlled in response to a control signal produced when the magnetic density of the toner mixture deviates from a reference density by a predetermined amount, characterized in that the reference density is varied during the lifetime of the toner mixture between an initial value at the start of the running-in period of a new toner mixture that ensures a satisfactory toner dispensing control at that moment, a final value at the end of the running-in period that ensures a satisfactory toner control during the remaining lifetime of the toner mixture, and at least one other value intermediate said initial and final values that ensures at least one corresponding intermediate moment having a satisfactory toner control, such at least three reference density values having been obtained by pre-assessing the change in characteristics of a new toner mixture during the running-in period thereof.

2. A method according to claim 1, wherein there are a plurality of other reference density values that each represent a correct reference density value at a particular stage of the running-in period of a new toner mixture, and wherein the application of each such particular value is governed by the elasped operating time of the toner mixture.

3. A method according to claim 2, wherein the number of exposure cycles is used as a measure for the elapsed operating time of the toner mixture.

4. A toner dispensing control device for a xerographic printer of the type wherein a photoconductor is electrostatically charged and image-wise exposed by line-wise exposing the photoconductor by means of appropriate activation of a plurality of linearly-spaced discrete sources of radiation in response to corresponding data bits, and developed by contact with a toner mixture attracted thereto from a mixture of magnetically-susceptible carrier particles and toner powder in a developing station provided with a toner dispenser, said control device comprising a magnetic density measuring circuit with means for measuring the magnetic density of carrier particles, means for producing a reference density, and means for comparing the measured density with the reference density and producing upon deviation of the actual from the reference magnetic density a toner dispensing signal, characterized in that the means for producing the reference density is adapted to produce a variable reference density, said means being controlled by signal control means that produces an output signal that is a function of the time of use of the toner mixture, said signal control means being responsive to time measuring means that measures the time of operation of the toner mixture.

5. A toner dispensing control device according to claim 4, wherein said time measuring means is formed by a print counter that signals the number of prints being made.

* * * * *